US005397673A

United States Patent [19]

Watson et al.

[11] Patent Number: 5,397,673

[45] Date of Patent: Mar. 14, 1995

[54] CURABLE STRIP-OUT DEVELOPMENT PROCESSES

[75] Inventors: P. Keith Watson, Rochester; Ian D. Morrison, Webster, both of N.Y.

[73] Assignee: Xerox Corporation, Stamford, Conn.

[21] Appl. No.: 971,742

[22] Filed: Nov. 5, 1992

[51] Int. Cl.[6] ..... G03G 13/14

[52] U.S. Cl. ..... 430/126; 430/97

[58] Field of Search ..... 430/126, 97

[56] References Cited

U.S. PATENT DOCUMENTS

| | | | |
|---|---|---|---|
| 3,275,436 | 9/1966 | Mayer | 430/121 |
| 3,661,614 | 5/1972 | Bessemir et al. | 117/38 |
| 4,003,868 | 1/1977 | Smith et al. | 522/103 |
| 4,215,167 | 7/1980 | Borden et al. | 428/203 |
| 4,303,924 | 11/1981 | Young, Jr. | 346/1.1 |
| 4,334,970 | 6/1982 | Lombardi et al. | 204/159.15 |
| 4,399,209 | 8/1983 | Sanders et al. | 430/138 |
| 4,443,495 | 4/1984 | Morgan | 427/96 |
| 4,604,340 | 7/1985 | Grossa | 430/270 |
| 4,680,368 | 7/1987 | Nakamato et al. | 528/49 |
| 4,751,102 | 6/1988 | Adair | 427/53.1 |
| 4,832,984 | 5/1989 | Hasegawa et al. | 427/161 |
| 4,881,084 | 11/1989 | Kan et al. | 346/1.1 |
| 4,943,816 | 7/1990 | Sparer | 346/25 |

FOREIGN PATENT DOCUMENTS

| | | |
|---|---|---|
| 0249156 | 12/1985 | Japan . |
| 1060714 | 3/1986 | Japan . |
| 1156261 | 7/1986 | Japan . |
| 1156262 | 7/1986 | Japan . |
| 1156263 | 7/1986 | Japan . |
| 1156264 | 7/1986 | Japan . |
| 1020056 | 11/1986 | Japan . |
| 2004714 | 1/1987 | Japan . |
| 2007716 | 1/1987 | Japan . |
| 2007717 | 1/1987 | Japan . |
| 2007718 | 1/1987 | Japan . |
| 2014168 | 1/1987 | Japan . |
| 2018574 | 1/1987 | Japan . |
| 2018575 | 1/1987 | Japan . |
| 2098364 | 5/1987 | Japan . |
| 2115171 | 5/1987 | Japan . |
| 3155055 | 6/1988 | Japan . |

OTHER PUBLICATIONS

Xerox Disclosure Journal–vol. 1, #5–May, 1976 Ultra–Violet Curable Liquid Immersion Development Toner.

Photographic Science and Engineering–vol. 21, #8, Nov. Dec. 1977–Photochemical Aspects of U V Curing–Y. C. Chang.

*Primary Examiner*—John Kight, III

*Assistant Examiner*—T. Mosley

*Attorney, Agent, or Firm*—Judith L. Byorick

[57] ABSTRACT

Disclosed is a process for forming images which comprises applying a curable liquid to a first substrate in an image pattern, optionally transferring the curable liquid image to a second substrate, subsequently contacting the curable liquid image with a solid developer so that the developer adheres to the curable liquid image, optionally transferring the curable liquid and the solid developer in image pattern to a third substrate, and curing the curable liquid in the image pattern to a solid.

33 Claims, No Drawings

CURABLE STRIP-OUT DEVELOPMENT PROCESSES

BACKGROUND OF THE INVENTION

The present invention is directed to a process for forming images. More specifically, the present invention is directed to a process for forming images with a curable liquid, wherein the uncured liquid is applied to a substrate in imagewise fashion, a developer comprising fine particles is subsequently applied to the liquid image, and the liquid is then cured to fix the image. One embodiment of the present invention is directed to a process for forming images which comprises applying a curable liquid to a first substrate in an image pattern, optionally transferring the curable liquid image to a second substrate, subsequently contacting the curable liquid image with a solid developer so that the developer adheres to the curable liquid image, optionally transferring the curable liquid and the solid developer in image pattern to a third substrate, and curing the curable liquid in the image pattern to a solid.

Curable inks are known in the printing industry. For example, U.S. Pat. No. 4,680,368 (Nakamoto et al.), the disclosure of which is totally incorporated herein by reference, discloses an ultraviolet curable ink composition comprising a polyurethane polymethacrylate obtained by reacting a polyisocyanate compound of the formula

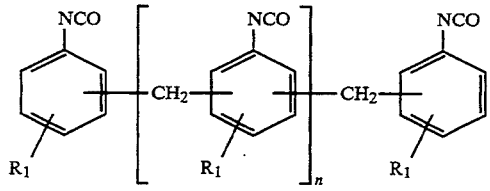

wherein $R_1$ is a hydrogen atom or a methyl group, and n is an integer of from 1 to 20, with a hydroxyl group containing methacrylate and having in one molecule at least two methacryloyl groups and at least two urethane bonds, a radical polymerizable low molecular weight compound, and a photopolymerization initiator.

In addition, U.S. Pat. No. 4,443,495 (Morgan et al.), the disclosure of which is totally incorporated herein by reference, discloses a heat curable conductive ink which comprises (1 ) an ethylenically unsaturated member of the group consisting of (a) a liquid ethylenically unsaturated monomer, oligomer, or prepolymer of the formula

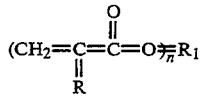

wherein R is H or $CH_3$, $R_1$ is an organic moiety and n is at least 2, (b) a polythiol in combination with (a), a polythiol in combination with a liquid ethylenically unsaturated monomer, oligomer, or prepolymer of the formula

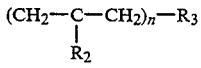

wherein $R_2$ is H or $CH_3$, $R_3$ is an organic moiety and n is at least 2, and (d) mixtures of (a), (b), and (c); (2) a thermal initiator; and (3) an electrically conductive material. Heating of the composition in a desired pattern on a substrate results in a printed electric circuit.

Further, U.S. Pat. No. 4,751,102 (Adair et al.), the disclosure of which is totally incorporated herein by reference, discloses a radiation curable ink composition comprising pigment and a photohardenable composition, wherein the photohardenable composition comprises a free radical addition polymerizable or crosslinkable compound and an ionic dye reactive counter ion compound which is capable of absorbing actinic radiation and producing free radicals which initiate free radical polymerization or crosslinking of the polymerizable or crosslinkable compound.

Additionally, U.S. Pat. No. 4,334,970 (Lombardi et al.), the disclosure of which is totally incorporated herein by reference, discloses a photosensitive resin system that is essentially solvent free and contains an ester produced from an unsaturated organic acid and a polyhydroxyl containing material, a photoinitiator, a carbonyl initiator, a monomer capable of reacting with an acrylic monomer, and an unsaturated hydroxyl containing polymer hydrocarbon.

Further, "Photochemical Aspects of UV Curing," Y. C. Chang, *Photographic Science and Engineering,* Vol. 21, No. 6 (1977) discloses the electro-optical properties of UV-curing materials, the effect of pigment dispersion on the curing rate of inks containing pigments, and the spectroscopic calibration of the degree of UV cure.

U.S. Pat. No. 3,661,614, U.S. Pat. No. 4,003,868, and U.S. Pat. No. 4,215,167, the disclosures of which are totally incorporated herein by reference, also disclose ultraviolet curable printing inks.

U.S. Pat. No. 4,399,209 (Sanders et al.), the disclosure of which is totally incorporated herein by reference, discloses a transfer imaging system wherein images are formed by imagewise exposing a layer comprising a chromogenic material and pressure rupturable capsules containing, as an internal phase, a photosensitive composition. When a coated composition containing the chromogenic material and the encapsulated photosensitive composition is exposed to actinic radiation and the capsules are subsequently ruptured in the presence of a developer, the image-forming reaction between the chromogenic material and the developer discriminately occurs in the exposed or unexposed areas and produces a detectable image. This result is accomplished by controlling whether the chromogenic material can transfer from the imaging sheet to the developer sheet. Generally, the photosensitive composition has a viscosity that changes upon exposure to actinic radiation such that upon exposure there is a change in the viscosity of the internal phase in the exposed areas, which imagewise determines whether the chromogenic material is accessible to the developer. The photosensitive composition may be a radiation curable composition which, upon exposure to light, increases in viscosity and immobilizes the chromogenic material, thereby preventing it from transferring to the developer sheet and reacting with the developer material. Alternatively, the chromogenic material can be encapsulated with a substance which is depolymerized or otherwise decreased in molecular weight upon exposure, resulting in a decrease in viscosity which renders the chromogenic material accessible or transferrable to the developer in the exposed areas.

Liquid developers and liquid development processes for the development of electrostatic latent images are also known. In electrophoretic developers and processes, the liquid developers generally comprise a liquid vehicle and colored toner particles, and frequently also contain a charge control agent. The colored toner particles become charged, and upon contacting the electrostatic latent image with the liquid developer, the particles migrate through the liquid vehicle toward the charged image, thereby effecting development. Any residual liquid vehicle remaining on the image subsequent to development is evaporated or absorbed into the receiving sheet. Typically, liquid developers employ hydrocarbon liquid vehicles, most commonly high boiling aliphatic hydrocarbons that are relatively high in resistivity and nontoxic. Developers and processes of this type are disclosed in, for example, U.S. Pat. No. 4,476,210, U.S. Pat. No. 2,877,133, U.S. Pat. No. 2,890,174, U.S. Pat. No. 2,899,335, U.S. Pat. No. 2,892,709, U.S. Pat. No. 2,913,353, U.S. Pat. No. 3,729,419, U.S. Pat. No. 3,841,893, U.S. Pat. No. 3,968,044, U.S. Pat. No. 4,794,651, U.S. Pat. No. 4,762,764, U.S. Pat. No. 4,830,945, U.S. Pat. No. 4,686,936, U.S. Pat. No. 4,766,049, U.S. Pat. No. 4,707,429, U.S. Pat. No. 4,780,388, U.S. Pat. No. 3,976,808, U.S. Pat. No. 4,877,698, U.S. Pat. No. 4,880,720, U.S. Pat. No. 4,880,432, and copending application U.S. Ser. No. 07/300,395, the disclosures of each of which are totally incorporated herein by reference.

In polarizable liquid development processes, as disclosed in U.S. Pat. No. 3,084,043 (Gundlach), the disclosure of which is totally incorporated herein by reference, liquid developers having relatively low viscosity and low volatility and relatively high electrical conductivity (relatively low volume resistivity) are deposited on a gravure roller to fill the depressions in the roller surface. Excess developer is removed from the lands between the depressions, and as a receiving surface charged in image configuration passes near the gravure roller, liquid developer is attracted from the depressions onto the receiving surface in image configuration by the charged image. Developers and processes of this type are disclosed in, for example, U.S. Pat. No. 4,047,943, U.S. Pat. No. 4,059,444, U.S. Pat. No. 4,822,710, U.S. Pat. No. 4,804,601, U.S. Pat. No. 4,766,049, Canadian Patent 937,823, Canadian Patent 926,182, Canadian Patent 942,554, British Patent 1,321,286, and British Patent 1,312,844, the disclosures of each of which are totally incorporated herein by reference.

Liquid developers containing curable resins in a liquid vehicle such as an aliphatic hydrocarbon are also known, as disclosed, for example, in "Ultra-Violet Curable Liquid Immersion Development Toner," C. C. Chow, Xerox Disclosure Journal, Vol. 1, No. 5 (1976), Japanese Patent 62-115 171, Japanese Patent 62-018 575, Japanese Patent 62-018 574, Japanese Patent 61-156 264, Japanese Patent 61-156 263, Japanese Patent 61-156 262, Japanese Patent 61-156 261, Japanese Patent 61-060 714, Japanese Patent 63-155 055, and Japanese Patent 62-098 364. In addition, U.S. Pat. No. 4,764,447, Japanese Patent 62-007 718, Japanese Patent 62-007 717, Japanese Patent 62-007 716, Japanese Patent 62-004 714, Japanese Patent 61-020 056, and Japanese Patent 60-249 156 disclose processes for polymerizing monomers in a hydrocarbon liquid vehicle to form dispersions of polymer particles suitable for use as liquid developers. Further, Japanese Patent 62-014168 discloses an encapsulated toner contained in a liquid vehicle. The capsule core can be cured by heat, and the monomers or oligomers become fixed to paper when images developed with the developer are cured.

U.S. Pat. No. 4,881,084 (Kan et al.), the disclosure of which is totally incorporated herein by reference, discloses a process of recording using fluid ink which is substantially non-adhesive but can be imparted with an adhesiveness upon application of an energy such as electrochemical energy or heat energy. The ink is obtained by impregnating a crosslinked substance such as guar gum or polyvinyl alcohol with a liquid dispersion medium such as water. The fluid ink, preferably formed into a layer in advance, is supplied with a pattern of energy to be provided with an adhesive pattern, which is then transferred to a recording medium, such as plain paper, directly or by the medium of an intermediate transfer medium to form an ink pattern corresponding to the energy pattern applied. If desired, the ink pattern can be developed with toner particles at a point downstream from the ink contact position.

U.S. Pat. No. 4,943,816 (Sporer), the disclosure of which is totally incorporated herein by reference, discloses a printer suitable for color printing which uses an ink printhead in which the marking fluid contains no dye so that a latent image of the desired print pattern is produced in the form of moistened spots directly on the print medium. The latent image is then developed by applying colored powder to the print medium, and the developed image is then fixed to the print medium to produce a visible image of the desired print pattern.

U.S. Pat. No. 4,303,924 (Young), the disclosure of which is totally incorporated herein by reference, discloses a jet drop printing process utilizing a radiation curable ink composition. The ink composition includes a low molecular weight multifunctional ethylenically unsaturated material, a low molecular weight monofunctional ethylenically unsaturated material, a reactive synergist, a dye colorant, and an oil soluble salt. A small amount of organic polar solvent and stabilizer may also be included. In addition, when a UV cure is used, a photoinitiator is also added to the mixture. The ink has a viscosity of less than about 15 centipoise, a resistivity of from 50 to 5,000 ohm-cm, and a surface tension of about 20 to 70 dynes per centimeter.

U.S. Pat. No. 4,604,340 (Grossa), the disclosure of which is totally incorporated herein by reference, discloses a process for the production of patterns on a substrate bearing a layer of a negative-working, light-sensitive composition comprising at least one 1,4-dihydropropyridine compound substituted in the 4 position by a 2'-nitrophenyl ring which becomes tacky and tonable on exposure to actinic radiation. The process comprises the steps of exposing the light sensitive layer imagewise to actinic radiation whereby tacky areas are formed, and toning the exposed tacky areas with finely divided powders.

U.S. Pat. No. 4,832,984 (Hasegawa et al.), the disclosure of which is totally incorporated herein by reference, discloses a method for forming an image comprising a step of applying ink to a recording medium having a light transmissive ink retaining layer and a light diffusing ink transporting layer on a substrate to form an image through the ink transporting layer in the ink retaining layer and a step of transparentizing the ink transporting layer.

U.S. Pat. No. 3,275,436 (Mayer), the disclosure of which is totally incorporated herein by reference, discloses a process of forming image reproductions which comprises in sequence the steps of presenting an adhesively tacky support base surface bearing a resist image into contact against a second support base containing a releasable uniform surface film selectively by area subjected to adhesive attraction, and separating the support bases from each other whereby the film from the second support base is released to the first support base in the surface areas devoid of the resist image.

Copending application U.S. Ser. No. 07/654,693, entitled "Curable Liquid Developers," with the named inventors Ian D. Morrison, Bing R. Hsieh, and Jerry H. Taylor, the disclosure of which is totally incorporated herein by reference, discloses a liquid developer comprising a colorant and a substantial amount of a curable liquid vehicle having a viscosity of no more than about 500 centipoise and a resistivity of no less than about $10^8$ ohm-cm.

While known processes are suitable for their intended purposes, a need remains for processes for forming images that overcome the disadvantages of known imaging methods. For example, while liquid electrophotographic development processes enable the generation of high quality and high resolution copies, one difficulty frequently encountered is an objectionable odor that typically accompanies liquid development processes. The sources of this odor are solvent vapors emitted from the copier or printer and the slow release of vapor from residual liquid vehicle remaining on the receiver sheet. A file drawer containing several documents prepared by liquid development processes can accumulate vapor to an unacceptable level. Accordingly, the reduction of solvent vapor emissions from liquid developing machines and from prints prepared with liquid developers is highly desirable for environmental and aesthetic purposes. In addition, ink jet printing processes using inks comprising soluble dyes can exhibit many problems, such as poor waterfastness, poor lightfastness, clogging of the jetting channels as a result of solvent evaporation and changes in the dye's solubility, dye crystallization, ink bleeding when prints are formed on plain papers, poor thermal stability, chemical instability, ease of oxidation, and low drop velocity. In addition, many of the dyes contained in inks may be potentially mutagenic. These problems can be minimized by replacing some of the dyes used in ink formulations with insoluble pigments. In general, pigments have superior properties with respect to dyes, such as good waterfastness, good lightfastness, good image density, thermal stability, oxidative stability, the ability to perform intercolor ink mixing, compatibility with both coated/treated and plain papers, and non-mutagenic properties. Pigment based inks, however, also exhibit difficulties, such as the pigment particles not remaining dispersed and precipitating from the liquid vehicle. Further, both dye based and pigment based inks exhibit the problem of nozzle clogging in ink jet printers, particularly when the printer has not been used for a period of time.

Thus, a need continues to exist for printing processes that produce prints with little or substantially no odor. A need also remains for printing processes that reduce or substantially eliminate the emission or carryout of solvent vapors from copiers and printers employing liquid inks. Further, there is a need for printing processes that enable the generation of high quality images. Additionally, a need exists for printing processes that reduce or eliminate the need to dispose of solvents from a copier or printer employing liquid inks. Further, there is a need for printing processes that enable formation of images with excellent fix to a substrate. In addition, a need remains for printing processes that enable simplified containment and capture procedures for reducing or eliminating solvent emissions for copiers or printers employing liquid inks. There is also a need for printing processes that overcome many of the difficulties commonly encountered in ink jet printing processes, such as poor waterfastness, poor lightfastness, clogging of the jetting channels, dye crystallization, ink bleeding when prints are formed on plain papers, poor thermal stability, chemical instability, ease of oxidation, and low drop velocity. A need also exists for printing processes with colored particulate materials which are not suitable for use in conventional electrostatic development processes such as xerography. Further, there is a need for printing processes that enable the use of materials that might not be stable in a liquid ink composition or in an electrographic powder toner, such as fibers, thin walled capsules, metallic particles, or the like, but can be applied to a curable liquid image by, for example; forming a donor layer of the material and applying it to the liquid image, followed by curing of the liquid. Additionally, there is a need for printing processes that enable creation of a high contrast, positive-negative pair of images.

SUMMARY OF THE INVENTION

It is an object of the present invention to provide printing processes with at least some of the above noted advantages.

It is another object of the present invention to provide printing processes that enable the generation of high quality images.

It is yet another object of the present invention to provide printing processes that reduce or eliminate the need to dispose of solvents from a copier or printer employing liquid inks.

Another object of the present invention is to provide printing processes that enable formation of images with excellent fix to a substrate.

Yet another object of the present invention is to provide printing processes that enable simplified containment and capture procedures for reducing or eliminating solvent emissions for copiers or printers employing liquid inks.

Still another object of the present invention is to provide printing processes that produce prints with little or substantially no odor.

It is another object of the present invention to provide printing processes that reduce or substantially eliminate the emission or carryout of solvent vapors from copiers and printers employing liquid inks.

It is yet another object of the present invention to provide printing processes that overcome many of the difficulties commonly encountered in ink jet printing processes, such as poor waterfastness, poor lightfastness, clogging of the jetting channels, dye crystallization, ink bleeding when prints are formed on plain papers, poor thermal stability, chemical instability, ease of oxidation, and low drop velocity.

It is still another object of the present invention to provide printing processes with colored particulate materials which are not suitable for use in conventional electrostatic development processes such as xerography.

It is yet another object of the present invention to provide printing processes that enable the use of materials that might not be stable in a liquid ink composition or in an electrographic powder toner but can be applied to a curable liquid image, followed by curing of the liquid.

It is still another object of the present invention to provide printing processes that enable creation of a high contrast, positive-negative pair of images.

These and other objects of the present invention (or specific embodiments thereof) can be achieved by providing a process for forming images which comprises applying a curable liquid to a first substrate in an image pattern, optionally transferring the curable liquid image to a second substrate, subsequently contacting the curable liquid image with a solid developer so that the developer adheres to the curable liquid image, optionally transferring the curable liquid and the solid developer in image pattern to a third substrate, and curing the curable liquid in the image pattern to a solid. In a specific embodiment, the curable liquid is partially polymerized prior to contacting the liquid image with the developer, thereby enhancing the tack of the liquid image. In another specific embodiment, the developer is applied to the liquid by preparing a donor element comprising a support and a releasable layer of the developer on the support, contacting the layer of developer on the donor element with the liquid image, and subsequently separating the donor element and the substrate bearing the liquid image, thereby causing the developer to separate from the support in an image pattern corresponding to the liquid image.

DETAILED DESCRIPTION OF THE INVENTION

The curable liquid can be any liquid suitable for the method selected for applying the liquid to the substrate in an image pattern and capable of being converted from a liquid to a solid. For example, the curable liquid can be applied to the substrate by a polarizable liquid development process, wherein the curable liquid is applied to an applicator such as a gravure roll and brought near an electrostatic latent image. When a curable liquid of the present invention suitable for polarizable liquid development processes is employed, the process entails generating an electrostatic latent image on an imaging member, applying the curable liquid to an applicator, and bringing the applicator into sufficient proximity with the latent image to cause the image to attract the liquid onto the imaging member, thereby developing the image. Processes of this type are disclosed in, for example, U.S. Pat. No. 4,047,943, U.S. Pat. No. 4,059,444, U.S. Pat. No. 4,822,710, U.S. Pat. No. 4,804,601, U.S. Pat. No. 4,766,049, U.S. Pat. No. 4,686,936, U.S. Pat. No. 4,764,446, Canadian Patent 937,823, Canadian Patent 926,182, Canadian Patent 942,554, British Patent 1,321,286, and British Patent 1,312,844, the disclosures of each of which are totally incorporated herein by reference. Any suitable means can be employed to generate the image. For example, a photosensitive imaging member can be exposed by incident light or by laser to generate a latent image on the member, followed by development of the image. In addition, an image can be generated on a dielectric imaging member by electrographic or ionographic processes.

The charged image polarizes the curable liquid in the depressions in the applicator, thereby drawing the liquid from the depressions and causing it to flow to the image bearing member to develop the image. For this application, the curable liquid is sufficiently viscous to remain in the depressions in the applicator prior to development. The viscosity, however, remains significantly lower than that typically observed for many printing inks, since the curable liquid must be capable of being pulled from the depressions in the applicator roll by the force exerted by the electrostatic latent image. Thus, curable liquids for use in polar development systems typically have a viscosity of from about 25 to about 500 centipoise at the operating temperature of the copier or printer, and preferably from about 30 to about 300 centipoise at the machine operating temperature. In addition, curable liquids intended for use in polarizable liquid development systems typically have a resistivity that enables the liquid to become polarized upon entering proximity with the electrostatic latent image. These resistivities, however, generally are significantly higher than the resistivities of typical printing inks, for which resistivities generally are substantially less than about $10^9$ ohm-cm. Typically, curable liquids for polarizable liquid development systems have a resistivity of from about $10^8$ to about $10^{11}$ ohm-cm, and preferably from about $2\times10^9$ to about $10^{10}$ ohm-cm. When the curable liquid is applied in imagewise fashion by a polarizable liquid development process, the image thus formed typically is then transferred from the imaging member bearing the electrostatic latent image (i.e., the first substrate) to a final substrate, such as paper, transparency material, cloth, or the like. The colored powder can be applied to the liquid image either before or after transfer from the imaging member (first substrate) to the final substrate. Similarly, the liquid can be cured either before or after transfer from the imaging member (first substrate) to the final substrate. When the electrostatic latent image is formed directly on a paper, such as in electrographic or ionographic processes as disclosed in, for example, U.S. Pat. No. 4,731,622, U.S. Pat. No. 4,485,982, U.S. Pat. No. 4,569,584, U.S. Pat. No. 3,611,419, U.S. Pat. No. 4,240,084, U.S. Pat. No. 3,564,556, U.S. Pat. No. 3,937,177, U.S. Pat. No. 3,729,123, U.S. Pat. No. 3,859,960, U.S. Pat. No. 2,919,171, U.S. Pat. No. 4,524,371, U.S. Pat. No. 4,619,515, U.S. Pat. No. 4,463,363, U.S. Pat. No. 4,254,424, U.S. Pat. No. 4,538,163, U.S. Pat. No. 4,409,604, U.S. Pat. No. 4,408,214, U.S. Pat. No. 4,365,549, U.S. Pat. No. 4,267,556, U.S. Pat. No. 4,160,257, and U.S. Pat. No. 4,155,093, the image generally is not transferred to an additional substrate, and the powder is usually applied directly to the curable liquid on the paper bearing the electrostatic latent image, followed by curing of the liquid to form solid images on the paper.

In addition, the curable liquid can be applied to a substrate imagewise by ink jet printing processes. Ink jet printing systems generally are of two types: continuous stream and drop-on-demand. In continuous stream ink jet systems, ink is emitted in a continuous stream under pressure through at least one orifice or nozzle. Multiple orifices or nozzles also can be used to increase imaging speed and throughput. The stream is ejected out of orifices and perturbed, causing it to break up into droplets at a fixed distance from the orifice. At the break-up point, the electrically charged ink droplets are passed through an applied electrode which is controlled and switched on and off in accordance with digital data signals. Charged ink droplets are passed through a controllable electric field which adjusts the trajectory of each droplet in order to direct it to either a gutter for ink collection and recirculation or a specific location on a recording medium to create images. The image creation is controlled by electronic signals.

In drop-on-demand systems, a droplet is ejected from an orifice directly to a position on a recording medium by pressure created by, for example, a piezoelectric device, an acoustic device, or a thermal process controlled in accordance with digital data signals. An ink droplet is not generated and ejected through the nozzles of an imaging device unless it is needed to be placed on the recording medium.

Since drop-on-demand systems require no ink recovery, charging, or deflection operations, the system is simpler than the continuous stream type. There are three types of drop-on-demand ink jet systems. One type of drop-on-demand system has an ink filled channel or passageway having a nozzle on one end and a regulated piezoelectric transducer near the other end to produce pressure pulses. A second type of drop-on-demand ink jet device is known as acoustic ink printing which can be operated at high frequency and high resolution. The printing utilizes a focused acoustic beam formed with a spherical lens illuminated by a plane wave of sound created by a piezoelectric transducer. The focused acoustic beam reflected from a surface exerts a pressure on the surface of the liquid, resulting in ejection of small droplets of ink onto an imaging substrate. The third type of drop-on-demand system is known as thermal ink jet, or bubble jet, and produces high velocity droplets and allows very close spacing of nozzles. The major components of this type of drop-on-demand system are an ink filled channel having a nozzle on one end and a heat generating resistor near the nozzle. Printing signals representing digital information generate an electric current pulse in a resistive layer (resistor) within each ink passageway near the orifice or nozzle, causing the ink in the immediate vicinity of the resistor to be heated substantially. This heating of the ink leads to its evaporation almost instantaneously with the creation of a bubble. The ink at the orifice is forced out of the orifice as a propelled droplet at high speed as the bubble expands. When the hydrodynamic motion of the ink stops after discontinuous heating followed by cooling, the subsequent ink emitting process is ready to start all over again. With the introduction of a droplet ejection system based upon thermally generated bubbles, commonly referred to as the "bubble jet" system, the drop-on-demand ink jet printers provide simpler, lower cost devices than their continuous stream counterparts, and yet have substantially the same high speed printing capability.

The operating sequence of the bubble jet system begins with a current pulse through the resistive layer in the ink filled channel, the resistive layer being in close proximity to the orifice or nozzle for that channel. Heat is transferred from the resistor to the ink. The ink becomes superheated far above its normal boiling point, and for water based ink, finally reaches the critical temperature for bubble nucleation and formation of around 280° C. and above. Once nucleated and expanded, the bubble or water vapor thermally isolates the ink from the heater and no further heat can be applied to the ink. This bubble expands rapidly due to pressure increase upon heating until all the heat stored in the ink in excess of the normal boiling point diffuses away or is used to convert liquid to vapor, which removes heat due to heat of vaporization. The expansion of the bubble forces a droplet of ink out of the nozzle located either directly above or on the side of a heater, and once the excess heat is removed with diminishing pressure, the bubble collapses on the resistor. At this point, the resistor is no longer being heated because the current pulse has been terminated and, concurrently with the bubble collapse, the droplet is propelled at a high speed in a direction towards a recording medium. Subsequently, the ink channel refills by capillary action and is ready for the next repeating thermal ink jet process. This entire bubble formation and collapse sequence occurs in about 30 microseconds. The heater generally is not reheated to eject ink out of the channel until 100 to 2,000 microseconds minimum dwell time have elapsed to enable the channel to be refilled with ink without causing any dynamic refilling problem. Thermal ink jet processes are well known and are described in, for example, U.S. Pat. No. 4,601,777, U.S. Pat. No. 4, 251,824, U.S. Pat. No. 4,410,899, U.S. Pat. No. 4,412,224, and U.S. Pat. No. 4,532,530, the disclosures of each of which are totally incorporated herein by reference.

Curable liquids suitable for use with ink jet printing methods generally have physical properties similar to those preferred for the inks conventionally employed in these processes. Preferred properties for continuous stream ink jet inks include a surface tension of greater than about 35 milliNewtons per meter ($mN \cdot m^{-1}$), a conductivity of greater than about $10^{-3}$ $(ohm\text{-}cm)^{-1}$, and a viscosity of from about 1 to about 2 milliNewton-seconds per square meter ($mN \cdot s \cdot m^2$). Preferred properties for drop-on-demand ink jet inks include a surface tension of greater than about 35 $mN \cdot m^{-1}$ and a viscosity of from about 1 to about 10 $mN \cdot s \cdot m^{-2}$. Inks for thermal drop-on-demand ink jet devices preferably also contain a sufficient amount of water or another volatile liquid to enable generation of a bubble upon heating of the ink.

The curable liquid can also be applied to the substrate by any other suitable method, such as gravure printing, letterpress, flexography, lithography, stylus writing (wherein the curable liquid is contained in a transfer element such as a ribbon and impact printing transfers the liquid from the element to the substrate), or the like.

Typical liquids suitable as the curable liquid for the present invention include ethylenically unsaturated compounds, including monomers, dimers, or oligomers having one or more ethylenically unsaturated groups such as vinyl or allyl groups, and polymers having terminal or pendant ethylenic unsaturation. Examples of curable liquids suitable for present invention include, but are not limited to, acrylate and methacrylate monomers or polymers containing acrylic or methacrylic group(s) of the general structure

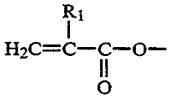

wherein $R_1$ is H or $CH_3$. The active group can be attached to an aliphatic or aromatic group with from 1 to about 20 carbon atoms and preferably from about 8 to about 12 carbon atoms, to an aliphatic or aromatic siloxane chain or ring with from 1 to about 20 dimethyl siloxane units, to a combination of the aforementioned groups, or to a polymer chain. Examples of such compounds include n-dodecyl acrylate, n-lauryl acrylate, methacryloxypropylpenta-methyldisiloxane, methyibis(trimethylsiloxy)-silylpropylgylcerolmethacrylate, bis(methacryloxybutyl)tetramethyl-disiloxane, 2-phenoxyethyl acrylate, polyethylene glycol diacrylate, ethyoxylated bisphenol A diacrylate, pentaerythritol triacrylate, poly(acryloxypropylmethyl)siloxane, methacrylate terminated polystyrene, polybutyldiene diacrylate, and the like. Further examples of curable liquids believed to be suitable for the present invention include acrylic and methacrylic esters of polyhydric alcohols such as trimethylolpropane, pentaerythritol, and the like, and acrylate or methacrylate terminated epoxy resins, acrylate or methacrylate terminated polyesters, and the like. Another polymerizable material is the reaction product of epoxidized soy bean oil and acrylic or methacrylic acid as described in U.S. Pat. No. 4,215,167, the disclosure of which is totally incorporated herein by reference, as well as the urethane and amine derivatives described therein. Additional examples of radiation curable substances include acrylate prepolymers derived from the partial reaction of pentaerythritol with acrylic acid or acrylic acid esters, including those available from Richardson Company, Melrose Park, Ill. Further, isocyanate modified acrylate, methacrylate and iraconic acid esters of polyhydric alcohols as disclosed in U.S. Pat. No. 3,783,151, U.S. Pat. No. 3,759,809, and U.S. Pat. No. 3,825,479, the disclosures of each of which are totally incorporated herein by reference, are believed to be suitable. Radiation curable compositions based on these isocyanate modified esters including reactive diluents such as tetraethylene glycol diacrylate as well as photoinitiators such as chlorinated resins, chlorinated paraffins, and amine photoinitiation synergists are commercially available from Sun Chemical Corporation under the trade name of Suncure. Also believed to be suitable are mixtures of pentaerythritol acrylate and halogenated aromatic, alicyclic, or aliphatic photoinitiators as described in U.S. Pat. No. 3,661,614, the disclosure of which is totally incorporated herein by reference, as well as other halogenated resins that can be crosslinked by ultraviolet radiation. Additionally, materials believed to be suitable are disclosed in U.S. Pat. No. 4,399,209, the disclosure of which is totally incorporated herein by reference.

Also suitable are epoxy monomers or epoxy containing polymers having one or a plurality of epoxy functional groups, such as those resins which result from the reaction of bisphenol A (4,4'-isopropylidenediphenoi) and epichlorohydrin, or by the reaction of low molecular weight phenolformaldehyde resins (Novolak resins) with epichlorohydrin, alone or in combination with an epoxy containing compound as a reactive diluent. Reactive diluents such as phenyl glycidyl ether, 4-vinylcyclohexene dioxide, limonene dioxide, 1,2-cyclohexane oxide, glycidyl acrylate, glycidyl methacrylate, styrene oxide, allyl glycidyl ether, and the like may be used as viscosity modifying agents. In addition, the range of these compounds can be extended to include polymeric materials containing terminal or pendant epoxy groups. Examples of these compounds are vinyl copolymers containing glycidyl acrylate or methacrylate as one of the comohomers. Other classes of epoxy containing polymers amenable to cure using the above cayalysts are epoxy-siloxane resins, epoxy-polyurethanes, and epoxypolyesters. Further examples of suitable epoxy resins are described in *Encyclopedia of Polymer Science and Technology,* 2nd edition, Wiley Interscience, New York, pages 322 to 382 (1986), *Methoden Der Organischen Chemie,* Vol. E20 part 3, Georg Thiame Verlag Stuttgart, New York, pages 1891 to 1994 (1987), Crivello, J. V. et al., *Journal of Polymer Science Part A: Polymer Chemistry,* 1990, 28, pages 479 to 503, and in Crivello, J. V. et al., Chemistry of Materials, 1989, 1, pages 445 to 451, the disclosures of each of which are totally incorporated herein by reference, epoxidized natural oils, such as epoxidized soybean oil, epoxidized linseed oil, epoxidized safflower oil, epoxidized corn oil, epoxidized cottoneed oil, epoxidized peanut oil, and the like, and epoxidized alkyl esters of oleic tall oil fatty acids (epoxytallates or epoxytofates).

Further examples of suitable curable materials include vinyl ether monomers, oligomers, or polymers containing vinyl ether groups of the general formula $$CHR_1{=}CR_2{-}O{-}$$

where $R_1$ and $R_2$ are hydrogen or alkyl groups with from 1 to about 10 carbon atoms, and preferably from 1 to 2 carbon atoms. Examples of such materials include decyl vinyl ether, dodecyl vinyl ether, hexadecyl vinyl ether, 4-chlorobutylvinyl ether, cyclohexyl vinyl ether, 1,4-cyclohexane dimethanol divinyl ether, diethylene glycol divinyl ether, butanediol divinyl ether, hexanediol divinyl ether, octanediol divinyl ether, decanediol divinyl ether. Further examples of vinyl ether monomers and polymers are shown in "Synthesis, Characterization, and Properties of Novel Aromatic Bispropenyi Ether" by J. V. Crivello and D. A. Conlon, *Journal of Polymer Science: Polymer Chemistry Edition,* Vol. 22, 2105–2121 (1984), "Aromatic Bisvinyl Ethers: A New Class of Highly Reactive Thermosetting Monomers" by J. V. Crivello and D. A. Conlon, *Journal of Polymer Science: Polymer Chemistry Edition,* Vol. 21, 1785–1799 (1983), "Vinyloxy-Functional Organopolysiloxane Compositions," by J. V. Crivello and R. P. Eckberg, U.S. Pat. No. 4,617,238, "Carbocataonic Polymerization of Vinyl Ethers" by T. Higashimura, M. Sawamoto in Comprehensive Polymer Science, Vol. (3), pages 673 to 696 (1989), "Polymerisation yon Vinylethern" by J. Reiners in *Methoden Der Organischen Chemie,* Vol. E20 part 2, Georg Thiame Verlag Stuttgart, New York, pages 1071–1115 (1987), the disclosures of each of which are totally incorporated herein by reference. Cyclic vinyl ethers with the following basic structure

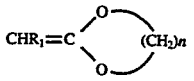

wherein $R_1$ is hydrogen or an alkyl group with from 1 to about 20 carbon atoms, and preferably from 1 to about 4 carbon atoms, and n=2 to about 20 and preferably from 3 to 8, are also useful, such as 4ophenyl-2-methylenetetrahydrofuran, 2-methylene-3,4-benzotetrahydrofuran, 2,2'-diphenyl-4-methylene- 1,3-dioxolane, 2-methyl-2-phenyl-4-methylene- 1,3-dioxolane and the like. Further examples can be found in "Ring-Opening Polymerization" by W. J. Bailey in *Comprehensive Polymer Science,* Vol. (3), pages 283 to 320, Pergamon Press (1989), the disclosure of which is totally incorporated herein by reference.

Also suitable are styrene and indene monomers or oligomers, and polymers containing styrenic or indenic groups of the general formula

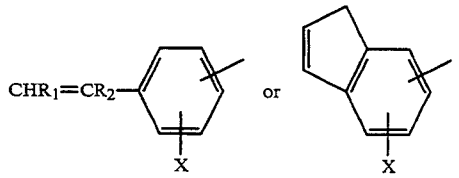

where $R_1$ and $R_2$ are H, alkyl, or aromatic groups, X is an electron donating group such as aikyl, alkoxy, N, N-dialkylamine groups and the like. The styrenic and indenic groups shown above can be attached to a polymer chain. Examples of such materials include butyistyrene, p-ethoxy styrene, p-butoxy styrene, p-octoxy styrene, o-allyloxystyrene, divinyl benzene, 1,4-bis(p-vinylbenzeneoxy) butane, 1,8-bis(p-vinylbenzeneoxy)octane, and the like. Further examples of styrene and indene monomers are disclosed in *Vinyl and Related Polymers,* by C. E. Schildknecht, Wiley and Sons, 1952, chapters 1, 2, and 3, and *Cationic Polymerization of Olefins: A Critical Inventory,* by J. P. Kennedy, Wiley and Sons, 1975, pages 228–330, the disclosures of each of which are totally incorporated herein by reference.

Also suitable are natural occurring unsaturated oils such as linseed oil, tung oil, oiticica oil, castor oil, fish oils, soybean oil, coconut oil, cottonseed oil, and the like. Natural occurring unsaturated resins are also suitable, such as manila resin, dammar resins, Congo and Kauri resins, Ester gum (glyceryl ester of rosin), phenolic resins, and the like. Further examples of naturally occuring materials of this type are disclosed in, for example, "Encyclopedia of Polymer Science and Engineering," "Coatings" volume 3, pages 615 to 675, by J. H. Lowell (1985), "Drying Oil" volume 5, pages 203 to 214, by Z. W. Wicks, Jr. (1986), and "Polymers from Renewable Sources" volume 12, pages 678 to 682, by L. H. Sperling and C. E. Carraher (1988) (Wiley & Sons), the disclosures of each of which are totally incorporated herein by reference.

In addition, vinyl acetal and ketene acetal monomers of the following general formulae are suitable

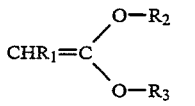

(I)

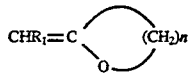

(II)

wherein $R_1$ is hydrogen or alkyl or aromatic groups with from 1 to about 20 carbon atoms, and preferably from 1 to about 6 carbon atoms, and $R_2$ and $R_3$ are alkyl or aromatic groups with from 1 to about 20 carbon atoms, and preferably from 1 to about 6 carbon atoms, n=2 to 20 and preferably from 3 to 8 as in the case of cyclic vinyl acetal (11). Typical examples include diethyl ketene acetal, di-butyl ketene acetal, diphenyl ketene acetal, 2-methylene- 1,3odioxepane, 4-phenyl-2-methylene- 1,3-dioxepane, 4,6-dimethyl-2-methylene-1,3-dioxane, 2-methylene- 1,3-dioxe-5-pene, 4-vinyl-2-methylene-1,3-dioxzlane, and the like. Further examples are disclosed in "Ring-Opening Polymerization" by W. J. Bailey in *Comprehensive Polymer Science,* Vol. 3, pages 283 to 320, Pergamon Press (1989), the disclosure of which is totally incorporated herein by reference.

Further, linear or branched aliphatic α-olefins, such as 1-dodecene, 5-methyl-1-heptene, 2,5-dimethyl-1,5-hexadiene, and the like, alicyclic olefins and diolefins, such as d-limonene, 1,4-dimethylenecyclohexane, 1-methylene-4-vinylcyclohexane, and the like, conjugated polyenes, such as 2-phenyl-1,3-butadiene, myrcene, allocimene, 1-vinylcyclohexene, ethylbenzofulvene, and the like, bicyclic olefins, such as α-pinene, β-pinene, 2-methylene-norbornane, and the like are all suitable carrier liquids. Further examples of these classes of olefins are disclosed in *Cationic Polymerization of Olefins: A Critical Inventory,* by J. P. Kennedy, Wiley and Sons, pages 1 to 228 (1975), the disclosure of which is totally incorporated herein by reference.

Liquid 1,2-polybutadiene resins of the formulae

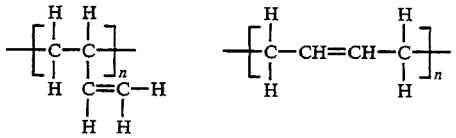

with a molecular weight between about 200 and about 3000, and preferably between about 200 and 1000, are also suitable. Thiol compounds are generally present as the comonomers with the olefin monomers. Typical examples include trithiol trimethylolethane tris(β-mercaptopropionate), tetrathiol pentaerythritol tetrakis(thiogylcolate), dimonene dimercaptane, and the like.

Other curable liquid materials include those that contain moieties such as cinnamic groups of the formula

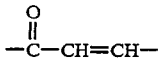

fumaric or maleic groups of the formula

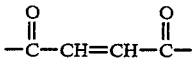

or maleimido groups of the formula

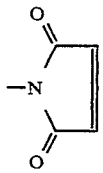

These functional groups can be present within either a monomer or a polymer comprising the liquid.

Specific examples include citrial, cinnamyl acetate, cinnamaldehyde, 4-vinylphenyl cinnamates, 4-vinylphenyl cinnamate, 4-nitrocinnamate, 4-isopropenylphenyl cinnamate, poly[1-(cinnamoyloxy-methylphenyl)ethylene], poly[1-(cinnamoyloxymethylphenyl)ethylene-co-1-[(4-nitrophenoxy)methylphenyl]ethylene], 3-(2-furyl-)acrolein), fumaric acid diethylester, fumaric acid dihexyl ester, maleic acid dibutylester, maleic acid diphenyl ester, N-phenyl maleinide, N-(4-butylphenyl) maleimide, m-phenylenediamine bis(maleimide), and N, N'-1,3 phenylenedimaleimide, and polyfunctional maleimide polymer MP-2000 from Kennedy and Klim, Little Silver, N.J.

In addition, monomers, dimers, or oligomers containing a multiplicity of one or more suitable functional groups can also be employed as the curable liquid.

Optionally, the curable liquid can contain a crosslinking agent. Crosslinking agents generally are monomers, dimers, or oligomers containing a multiplicity of functional groups, such as two styrene functionalities, a styrene functionality and an acrylate functionality, or the like. The curable liquid can consist entirely of these multifunctional monomers, dimers, or oligomers, can contain no crosslinking agent at all, and can contain both monofunctional monomers, dimers, or oligomers and multifunctional monomers or oligomers. Generally, the presence of a crosslinking agent is preferred to provide improved film forming characteristics, faster curing, and improved adhesion of the cured image to the substrate. When present, the crosslinking agent is present in an effective amount, typically from about 1 to about 95 percent by weight of the curable liquid and preferably from about 10 to about 50 percent by weight of the curable liquid.

Additional examples of curable liquids include those materials disclosed in, for example, U.S. Pat. No. 3,989,644, U.S. Pat. No. 4,264,703, U.S. Pat. No. 4,840,977, and U.S. Pat. No. 4,933,377, the disclosures of each of which are totally incorporated herein by reference.

The curable liquids for the present invention can also contain an initiator to initiate curing of the liquid. The initiator can be added before or after formation and development of the image. Any suitable initiator can be employed provided that the objectives of the present invention are achieved; examples of the types of initiators suitable include thermal initiators, radiation sensitive initiators such as ultraviolet initiators, infrared initiators, visible light initiators, or the like, initiators sensitive to electron beam radiation, ion beam radiation, gamma radiation, or the like. In addition, combinations of initiators from one or more class of initiators can be employed. Radical photoinitiators and radical thermal initiators are well known, as is electron beam curing; these materials and processes are disclosed in, for example, "Radiation Curing of Coatings," G. A. Senich and R. E. Florin, *Journal of Macromolecular Science Review. Macromol. Chem. Phys.*, C24(2), 239–324 (1984), the disclosure of which is totally incorporated herein by reference. Examples of initiators include those that generate radicals by direct photofragmentation, including benzoin ethers such as benzoin isobutyl ether, benzoin isopropyl ether, benzoin methyl ether and the like, acetophenone derivatives such as 2,2-dimethoxy-2-phenylacetophenone, dimethoxyacetophenone, 4-(2-hydroxyethoxy)phenyl-(2-propyl)ketone, 2-hydroxy-2-methyl- 1 -phenyl-propan-1-one, 2,2,2-trichloroacetophenone, 2,4,6-trimethylbenzoyldiphenylphospine oxide, and the like; initiators that form radicals by bimolecular hydrogen transfer, such as the photoexcited triplet state of diphenyl ketone or benzophenone, diphenoxybenzophenone, bis(N,N-dimethylphenyl) ketone or Michler's ketone, anthraquinone, 4-(2-acryloyloxyethyoxy)-phenyl-2ohydroxy-2-propylketone and other similar aromatic carbonyl compounds, and the like; initiators that form radicals by electron transfer or via a donor-acceptor complex, also known as an exciplex, such as methyldiethanolamine and other tertiary amines; photosensitizers used in combination with a radical generating initiator, wherein the sensitizer absorbs light energy and transfers it to the initiator, such as a combination of a thioxanthone sensitizer and a quinoline sutfonyl chloride initiator and similar combinations; cationic initiators that photolyze to strong Lewis acids, such as aryidiazonium salts of the general formula $Ar-N_2^+X^-$ wherein Ar is an aromatic ring such as butyi benzene, nitrobenzene, dinitrobenzene, or the like and X is $BF_4$, $PF_6$, $AsF_6$, $SbF_6$, $CF_3SO_3$, or the like, diaryliodonium salts of the general formula $Ar_2I^+X^-$, wherein Ar is an aromatic ring such as methoxy benzene, butyl benzene, butoxy benzene, octyl benzene, didecyl benzene, or the like, and X is an ion of low nucleophilicity, such as $PF_6$, $AsF_6$, $BF_4$, $SbF_6$, $CF_3SO_3$, and the like; triaryisulfonium salts of the general formula $Ar_3S^+ X^-$, wherein Ar is an aromatic ring such as hydroxy benzene, methoxy benzene, butyl benzene, butoxy benzene, octyl benzene, dodecyl benzene, or the like and X is an ion of low nucleophilicity, such as $PF_6$, $AsF_6$, $SbF_6$, $BF_4$, $CF_3SO_3$, or the like; nonradical initiators comprising amine salts of alpha-ketocarboxylic acids, such as the tributyl ammonium salt of phenylglyoxylic acid; and the like, as well as mixtures thereof. Further photoacid generating initiators are disclosed in "The Chemistry of Photoacid Generating Compounds," by J. V. Crivello in *Proceedings of the ACS Division of Polymeric Materials: Science and Engineering,* Vol. 61, pages 62–66, (1989), "Redox Cationic Polymerization: The Diaryliodonium Salt/Ascorbate Redox Couple," by J. V. Crivello and J. H. W. Lam in *Journal of Polymer Science: Polymer Chemistry Edition,* Vol. 19, pages 539–548 (1981), "Redox-lnduced Cationic Polymerization: The Diaryliodonium Salt/Benzoin Redox Couple," by J. V. Crivello and J. L. Lee in *Journal of Polymer Science: Polymer Chemistry Edition,* Vol. 21, pages 1097–1110 (1983), "Diaryliodonium Salts as Thermal Initiators of Cationic Polymerization," by J. V. Crivello, T. P. Lockhart and J. L. Lee in *Journal of Polymer Science: Polymer Chemistry Edition,* Vol. 21, pages 97–109 (1983), the disclosures of each of which are totally incorporated herein by reference.

Further examples of suitable initiators include alpha-alkoxy phenyl ketones, O-acylated alpha-oximinoketones, polycyclic quinones, xanthones, thioxanthones, halogenated compounds such as chlorosulfonyl and chloromethyl polynuclear aromatic compounds, chlorosulfonyl and chloromethyl heterocyclic compounds, chlorosulfonyl and chloromethyl benzophenones and fluorenones, haloalkanes, alpha-halo alphaphenylacetophenones, photoreducible dye-reducing agent redox couples, halogenated paraffins such as brominated or chlorinated paraffin, benzoin alkyl esters, cationic diborate anion complexes, anionic di-iodonium ion compounds, and anionic dye-pyrrilium compounds.

Additional examples of suitable initiators are disclosed in, for example, U.S. Pat. No. 4,683,317, U.S. Pat. No. 4,378,277, U.S. Pat. No. 4,279,717, U.S. Pat. No. 4,680,368, U.S. Pat. No. 4,443,495, U.S. Pat. No. 4,751,102, U.S. Pat. No. 4,334,970, "Complex Triarylsulfonium Salt Photoinitiators I. The Identification, Characterization, and Syntheses of a New Class of Triaryisulfonium Salt Photoinitiators," J. V. Crivello and J. H. W. Lam, *Journal of Polymer Science: Polymer Chemistry Edition,* Vol. 18, 2677–2695 (1980); "Complex Triarylsulfonium Photoinitiators II. The Preparation of Several New Complex Triarylsulfonium salts and the Influence of Their Structure in Photoinitiated Cationic Polymerization," J. V. Crivello and J. H. W. Lam, *Journal of Polymer Science Polymer Chemsitry Edition,* Vol. 18, pages 2697–2714 (1980); "Diaryliodonium Salts A New Class of Photoinitiators for Cationic Polymerization," J. V. Criveilo and J. H. W. Lam, *Maromolecules,* Vol. 10, pages 1307–1315 (1977); and "Developments in the Design and Applications of Novel Thermal and Photochemical Initiators for Cationic Polymerization" by J. V. Crivello, J. L. Lee and D. A. Conlon in Makromol. Chem. Macromolecular Symposium, Vol. 13/14, pages 134–160 (1988), the disclosures of each of which are totally incorporated herein by reference. Particularly preferred are the diaryl iodonium salts and their derivatives, the triaryl sulfonium salts and their derivatives, and the triphenyl phosphonium salts and their derivatives, with examples of derivatives being those with alkyl, aryl, or alkoxy substituents on the aryl rings. The initiator is present in the curable liquid in any effective amount, typically from about 0.1 to about 10 percent by weight of the liquid, and preferably from about 0.1 to about 3 percent by weight of the liquid.

When a photoinitiator is selected, photopolymerization can be performed with the aid of an autoxidizer, which is generally a compound capable of consuming oxygen in a free radical chain process. Examples of useful autoxidizers include N,N-dialkylaninines, particularly those substituted in one or more of the ortho, meta, or para positions with groups such as methyl, ethyl, isopropyl, t-butyl, 3,4-tetramethylene, phenyl, trifluoromethyl, acetyl, ethoxycarbonyl, carboxy, carboxylate, trimethylsilylmethyl, trimethylsilyl, triethylsilyl, trimethyigermanyl, triethylgermanyl, trimethylstannyl, triethylstannyl, n-butoxy, n-pentyloxy, phenoxy, hydroxy, acetyl-oxy, methylthio, ethylthio, isopropylthio, thio-(mercapto-), acetylthio, fluoro, chloro, bromo, or iodo. Autoxidizers when present are present in an effective amount, typically from about 0.1 to about 5 percent by weight, of the curable liquid.

A UV sensitizer which could impart electron transfer, and exciplex-induced bond cleavage processes during radiation curing can, if desired, be included in the liquid developers of the present invention. Typical photosensitizers include anthrecene, perylene, phenothiazine, thioxanthone, benzophenone, fluorenone, and the like. The sensitizer is present in an effective amount, typically from about 0.1 to about 5 pecent by weight, of the curable liquid.

The curable liquids of the present invention can also contain various polymers added to modify the viscosity of the liquid or to modify the mechanical properties of the developed or cured image such as adhesion or cohesion. In particular, when the curable liquid of the present invention is intended for use in polarizable liquid development processes, the liquid can also include viscosity controlling agents. Examples of suitable viscosity controlling agents include thickeners such as alkylated polyvinyl pyrrolidones, such as Ganex V216, available from GAF; polyisobutylenes such as Vistanex, available from Exxon Corporation, Kalene 800, available from Hardman Company, N.J. ECA 4600, available from Paramins, Ontario, and the like; Kraton G-1701, a block copolymer of polystyrene-b-hydrogenated butadiene available from Shell Chemical Company, Polypale Ester 10, a glycol rosin ester available from Hercules Powder Company; and other similar thickeners. In addition, additives such as pigments, including silica pigments such as Aerosil 200, Aerosil 300, and the like available from Degussa, Bentone 500, a treated montmorillonite clay available from NL Products, and the like can be included to achieve the desired developer viscosity. Additives are present in any effective amount, typically from about 1 to about 40 percent by weight in the case of thickeners and from about 0.5 to about 5 percent by weight in the case of pigments and other particulate additives.

In addition, curable liquids of the present invention intended for use in polarizable liquid development processes can also contain conductivity enhancing agents. For example, the liquids can contain additives such as quaternary ammonium compounds as disclosed in, for example, U.S. Pat. No. 4,059,444, the disclosure of which is totally incorporated herein by reference.

Further, curable liquids of the present invention intended for use in ink jet processes can also contain water or a mixture of water and a miscible organic component, such as ethylene glycol, propylene glycol, diethylene glycols, glycerine, dipropylene glycols, polyethylene glycols, polypropylene glycols, amides, ethers, carboxylic acids, esters, alcohols, organosulfides, organosulfoxides, sulfones, dimethylsuifoxide, sulfolane, alcohol derivatives, carbitol, butyl carbitol, cellusolve, ether derivatives, amino alcohols, ketones, and other water miscible materials, as well as mixtures thereof. When mixtures of water and water miscible organic liquids are selected as the liquid vehicle, the water to organic ratio may be in any effective range, and typically is from about 100:0 to about 30:70, preferably from about 97:3 to about 50:50, although the ratio can be outside these ranges. The non-water component of the liquid vehicle generally serves as a humectant which has a boiling point higher than that of water (100° C.). Other additives can also be present. For example, surfactants or wetting agents can be added to the liquid. These additives may be of the cationic, anionic, or nonionic types. Suitable surfactants and wetting agents include Tamol ® SN, Tamol ® LG, those of the Triton ® series available from Rohm and Haas Co., those of the Marasperse ® series, those of the Igepal ® series available from GAF Co., those of the Tergitol ® series, those of the Duponol ® series available from E. I. Du Pont de Nemours & Co., Emulphor ON 870 and ON 877, available from GAF, and other commercially available surfactants. These surfactants and wetting agents are present in effective amounts, generally from 0 to about 15 percent by weight, and preferably from about 0.01 to about 8 percent by weight, although the amount can be outside these ranges. Polymeric additives can also be added to enhance the viscosity of the liquid, including water soluble polymers such as Gum Arabic, polyacrylate salts, polymethacrylate salts, polyvinyl alcohols, hydroxy propylcellulose, hydroxyethylcellulose, polyvinylpyrrolidinone, polyvinylether, starch, polysaccharides, polyethyleneimines derivatized with polyethylene oxide and polypropylene oxide, such as the Discole series available from DKS International, Tokyo, Japan, the Jeffamine ® series available from Texaco, Bellaire, Tex., and the like. Polymeric additives may be present in the liquid in any effective amount, typically from 0 to about 10 percent by weight, and preferably from about 0.01 to about 5 percent by weight, although the amount can be outside these ranges. Other optional additives include biocides such as Dowicil 150, 200, and 75, benzoate salts, sorbate salts, and the like, present in an amount of from about 0.0001 to about 10 percent by weight, and preferably from about 0.01 to about 4.0 percent by weight, although the amount can be outside these ranges, penetration control additives such as N-methylpyrrolidinone, sulfoxides, ketones, lactones, esters, alcohols, butyl carbitol, benzyl alcohol, cyclohexylpyrrolidinone, 1,2-hexanediol, and the like, present in an amount of from 0 to about 50 percent by weight, and preferably from about 5 to about 40 percent by weight, although the amount can be outside these ranges, pH controlling agents, such as acids or bases, phosphate salts, carboxylates salts, sulfite salts, amine salts, and the like, present in an amount of from 0 to about 1 percent by weight and preferably from about 0.01 to about 1 percent by weight, although the amount can be outside these ranges, or the like.

Liquids used in ink jet processes can also contain an ionic compound at least partially ionizable in the liquid to enhance the conductivity of the liquid. Preferably, the ionic compound is selected so that a relatively small amount is required in the liquid to obtain the desired conductivity. For example, it is preferred that the ionic compound exhibit a high degree of dissociation in the liquid, since a higher degree of dissociation results in more free ions present in the liquid and thus results in higher conductivity for a given weight amount of the ionic compound. Generally, preferred ionic compounds exhibit a degree of dissociation of about 100 percent, although ionic compounds exhibiting lower degrees of dissociation can also be used. The ionic compound can be an acid, a base, or a salt. Typical cations include but are not limited to $H+$, $Li+$, $Na+$, $K+$, $Mg^{2}+$, $Ca^{2}+$, $Fe^{2}+$, $Fe^{3}+$, $Al^{3}+$, $NH_4+$, and the like. Typical anions include but are not limited to $OH-$, $F-$, $Cl-$, $Br-$, $I-$, $NO_3-$, $SO_42-$, $CH_3COO^-$, and the like. Specific examples of suitable acids include but are not limited to HCl, HBr, HI, $HNO_3$, $H_2SO_4$, acetic acid, and the like. Specific examples of bases include but are not limited to. LiOH, NaOH, KOH, $Mg(OH)_2$, $Ca(OH)_2$, $Fe(OH)_2$, $Fe(OH)_3$, $Al(OH)_3$, $NH_4OH$, and the like. Specific examples of suitable salts include but are not limited to NaCl, $CaCl_2$, NaI, $NaNO_3$, $(NH_4)_2SO_4$, $NH_4Cl$, LiCl, and the like. Generally, ionic compounds that enable higher conductivity per weight unit of ionic compound present in the liquid are preferred. For example, compounds containing low molecular weight cations and anions generally result in higher conductivity per weight unit of compound present in the liquid than do ionic compounds containing high molecular weight cations and anions. Thus, a liquid containing 1 percent by weight of lithium chloride exhibits higher conductivity than a liquid containing 1 percent by weight of potassium iodide, since the liquid containing lithium chloride contains more free ions per unit of weight than the liquid containing potassium iodide. Ionic compounds wherein only a small amount is required in the liquid to achieve the desired conductivity are particularly preferred when the other liquid components or characteristics, such as the dye or the colloidal dispersion stability, can be adversely affected by the presence of large amounts of ions. The ionic compound preferably is selected to optimize solubility of the other ingredients.

The amount of the ionic compound present in the liquid can vary. Typically, the liquid contains from about 0.25 to about 30 percent by weight of the ionic compound; for inorganic ionic compounds, preferably the liquid contains from about 0.5 to about 5 percent by weight of the ionic compound, and for organic ionic compounds, preferably the liquid contains from about 0.5 to about 25 percent by weight of the ionic compound, although the amounts can be outside of these ranges provided that the desired conductivity is achieved. This amount reflects the total amount of ionic compound present in the liquid; thus, if another liquid component, such as a dye or one of the additives, is also ionic, the amount of this material is also included in these ranges. The amount of the ionic compound present generally will also depend on the size and valency of the ions in the compound, the desired printing process speed, the desired liquid conductivity, the size of the image with respect to dimensions and liquid deposition density (milligrams per square centimeter) on paper, and the like.

In some embodiments, the curable liquids employed in the process of the present invention have a conductivity of at least about 10 milliSiemens per centimeter, preferably at least 12 milliSiemens per centimeter, and more preferably from about 20 to about 50 milliSiemens per centimeter.

The liquid image is then developed with a solid developer material. The developer material typically comprises a powder having particles small enough to provide good resolution in the image, typically less than about 5 millimeters in diameter, and preferably less than about 100 microns in diameter. The particle size can be as small as desired, and preferably is no smaller than the lower safe limit for the handling of fine powders, generally no smaller than about 1 micron in diameter and preferably no smaller than about 4 microns in diameter. The particle size distribution generally is not important provided that the particle sizes lie in the desired range.

The developer is selected so that surfaces of the particles adhere well to the liquid layer, but the developer need not have any other particular properties. Generally, the composition of the liquid layer is chosen so that it will adhere to the selected developer. Because the optical properties of the image are generally degraded by surface roughness, the smoother the surface of the developer, the better the image appears, especially when light is projected through the image (such as occurs when images are generated on transparencies and viewed through an overhead projector). A smooth image surface also decreases the possibility of air being trapped in the image.

One particular advantage of the present invention is that the range of suitable developer compositions is much broader than the range of materials that can be selected for other imaging processes. For example, the developers appropriate for the present invention need not have the triboelectric properties required of toners used in xerographic processes. The developers useful for the processes of the present invention can be electrical insulators, electrical conductors, or even magnetic particles. The materials for the developer can be chosen for their unique optical properties, such as reflectivity or glitter. The materials for the developer can also be selected for their tactile properties, such as might be useful for printing Braille messages or images that can be sensed by other means of contact such as with a stylus. The materials for the developer can also be selected for their magnetic properties, so that the image can be detected by magnetic sensors such as in magnetic image character recognition and the like.

The developer can comprise pigment particles, a mixture of two or more kinds of pigment particles, transparent particles containing one or more kinds of pigment, transparent particles containing one or more dyes, mixtures of transparent particles containing dyes and/or pigments, and the like. The particle size can be adjusted to vary the optical density obtained in the developed image. For example, when pure pigment particles are used, the particle size is usually small, typically less than about 10 microns. When pigment particles are contained in transparent particles, the particle size required to achieve a given optical density generally increases inversely with the concentration of pigment in the particles. When dyes are used to color transparent particles, the particle size to obtain a given optical density typically is slightly greater than the particle size of another material which enables that optical density but containing a concentration by weight of pigment similar to the concentration by weight of the dye. When a transparent particle is used, the pigment or dye can be either coated onto the particle surfaces or mixed within the bulk material of the particles. When the pigment or dye is mixed within the bulk of the particles, it preferably is well and uniformly dispersed. Examples of materials of this kind include dry xerographic toners, including colored, black, and magnetic toners.

When the developer is to be used to form a colored or black image, the color density of the pigment preferably is sufficiently high to enable a single layer of pigment to have an optical density of about 1.4 to 2.0 Optical Density units.

The developer can be chemically inert with respect to the liquid layer, or it can be chemically active. The chemical activity can be such that the developer contains a component which will react with the liquid layer when it is cured, such as some of the curable liquid monomer, either monofunctional or multifunctional. One advantage of including some of the curable liquid components in the composition of the developer is that adhesion of the developer to the liquid is improved. The developer can also contain some or all of the initiator used to cure the liquid layer. An advantage of having the initiator of the curable liquid contained in the developer is that the liquid is not subject to unwanted or spontaneous curing.

The liquid image is developed by any suitable method of applying the developer material to the liquid. In some instances, it may be desirable to enhance the tackiness of the liquid layer by partially curing the liquid image prior to application of the colored material. One suitable means of applying the developer material to the liquid entails the use of conventional xerographic techniques. For example, toner particles can be brushed over the image by means of a magnetic brush, or by a monocomponent scavengeless donor roll, wherein the toner particles adhere to the liquid but not to the surrounding areas. When these methods are used, it may be preferred to cure the liquid image partially prior to development to render the image tacky and more attractive to the developer particles. Other conventional xerographic development techniques, both those involving contact of the toner applicator to the image and those entailing non-contact "jumping" development, can also be used, such as powder cloud development, cascade development, and the like.

Another suitable means for applying the developer material to the liquid image entails stripping the image from a donor layer of the developer material. In this instance, the developer material is applied in a layer to a support to form a donor element, the substrate bearing the liquid image is brought into contact with the layer of developer material on the donor element, and the substrate and donor element are subsequently separated, resulting in formation of a positive image on the substrate, where the developer material has adhered to the liquid image, and a negative image on the donor element, where developer material has been removed in imagewise fashion. The donor element can have any suitable configuration, such as a sheet, a strip, a cylindrical roll, a continuous belt, or the like.

When a donor element is employed to develop the liquid image, higher quality images are obtained if the donor layer comprises a uniform layer of developer particles; this uniformity of the donor layer is most readily achieved if the support portion of the donor element, upon which the donor layer of particles resides, is smooth. In addition, if high resolution images are desired, it is preferred that the support portion of the donor element be thin and flexible, thus allowing the donor element to conform to the image and make the contact between liquid image and donor layer of developer material more complete. As is well known, the resolution in a particulate system is limited by the particle size and particle size uniformity of the developing particles. The internal bond between particles in the donor layer and the bond between particles in the donor layer and the substrate of the donor element preferably are great enough to ensure the integrity of the donor element, but not so great as to prevent stripping of the developer material from the support in imagewise fashion upon contact with the liquid image and subsequent separation of the substrate and the donor element. Preferably, the support is of an expendable material, although in some instances it is also desired to use the complementary image remaining on the support, in which case this image may be fused or fixed to the support by any suitable means, such as heat, application of vapor or solvents, application of a curable liquid followed by curing of the liquid, or the like. In addition, if the support of the donor element is transparent, the negative image remaining on the support after separation of the substrate bearing the liquid image from the donor element can be fixed to the support and the resulting image can be optically projected. Particularly preferred materials for the donor element support include polyester films, such as Mylar®, which exhibit dimensional stability, high strength, and transparency. The donor layer of developer material should be uniformly releasable from the support, and a layer of particles is generally the preferred configuration. Other configurations, however, such as evaporated metal coatings of antimony, aluminum, silver, and other metals have properties suitable for developing liquid images according to the process of the present invention in that they form a frangible layer of low adhesion to the support and enable images to be readily stripped out from the evaporated layer by contact with the substrate bearing the liquid image. Similarly suitable is a layer of a frangible material, such as a layer of pigment particles or a dye that can be applied to the support by evaporation, solution coating, or the like.

Subsequent to development of the liquid image with the solid developer material, the image is cured, causing the curable liquid to solidify. When development of the image takes place on an imaging member or intermediate prior to transfer to a final substrate, curing can take place before transfer or after transfer. In situations such as electrographic imaging wherein the image is developed directly on the substrate and no transfer occurs, the image is cured subsequent to development. When transfer to a substrate is desired, the developed image can be partially cured prior to transfer; partial curing can impart tacky surface characteristics to the developed image, which can enhance transfer to a substrate. In addition, curing subsequent to transfer can greatly enhance adhesion of the image to the final substrate, since the curable liquid can penetrate the final substrate, particularly when the final substrate is porous, such as cloth or paper, and curing results in the image being tightly bound to the fibers of the substrate. In addition, curing subsequent to transfer can greatly enhance adhesion to the final substrate, whether the final substrate is smooth or porous, when the final substrate has reactive sites, either naturally occurring as in cellulose or clays, or added as a precoating, with which reactive species in the liquid developer can react.

Curing can be by any suitable means, and generally is determined by the nature of the initiator selected, if any. When a photoinitiator is selected, curing is effected by exposure of the image to radiation in the wavelength to which the initiator is sensitive, such as ultraviolet light. Examples of suitable ultraviolet lamps include low pressure mercury lamps, medium pressure mercury lamps, high pressure mercury lamps, xenon lamps, mercury xenon lamps, arc lamps, gallium lamps, lasers, and the like. When a thermal initiator is selected, the image is heated to a temperature at which the initiator can initiate curing of the liquid vehicle and maintained at that temperature for a period sufficient to cure the image. Electron beam curing can be initiated by any suitable electron beam apparatus. Examples include scanned beam apparatuses, in which electrons are generated nearly as a point source and the narrow beam is scanned electromagnetically over the desired area, such as those available from High Voltage Engineering Corporation, Radiation Dynamics, Inc. (a subsidiary of Monsanto Company), Polymer Physik of Germany, or the Dike, and linear-filament apparatuses or curtain processor apparatuses, in which electrons are emitted from a line-source filament and accelerated perpendicular to the filament in a continuous linear curtain, such as those available from Energy Sciences, Inc. under the trade name Electrocurtain. Ion beam curing can be initiated by any suitable means, such as a corotron.

Specific embodiments of the invention will now be described in detail. These examples are intended to be illustrative, and the invention is not limited to the materials, conditions, or process parameters set forth in these embodiments. All parts and percentages are by weight unless otherwise indicated.

EXAMPLE I

A curable liquid suitable for use in polarizable liquid development processes is prepared as follows. A solution comprising 30 percent by weight of styrene-butylmethacrylate copolymer (containing 50 mole percent styrene, 50 mole percent butylmethacrylate) with a molecular weight of about 50,000 in butanediol divinyl ether (Rap[-Cure BDVE, available from GAF, Linden, N.J.) is prepared by mixing together the ingredients. Subsequently, to 10 parts by weight of this solution is added 90 parts by weight of decyl vinylether (Decave, available from International Flavors and Fragrances, Inc., New York, N.Y.). Thereafter, 0.20 parts by weight of a di(isobutylphenyl)iodinium hexafluoroarsenate polymerization initiator (prepared as described by Crivello and Lam in *Macromolecules,* 10(6) 1307 (1977), the disclosure of which is totally incorporated herein by reference) is mixed with 4.54 parts by weight of decyl vinylether (Decave) and 4.54 parts by weight of butanediol divinylether (Rap[-Cure BDVE) to form an initiator dispersion. Subsequently, 90 parts by weight of the solution containing the copolymer are mixed with 10 parts by weight of the initiator dispersion to form the curable liquid.

An electrostatic image is generated by exposure of a print test pattern to the photoreceptor in a Xerox ®/-Cheshire ®DI 785 label maker, which employs a polarizable liquid development process. The electrostatic image is then developed with the curable liquid. The liquid image on the photoreceptor is then transferred to a paper substrate by contacting the paper to the imaging member. The paper bearing the liquid image is then contacted with a donor element comprising a Mylar ® support coated with a uniform layer of xerographic toner particles deposited on the support by a biased magnetic brush development process. On areas of the paper bearing the liquid image, toner is transferred from the donor element to the paper to form a colored image corresponding to the liquid image. Thereafter, the image is fixed by passing the paper bearing the image through a Hanovia UV-6 cure station (Hanovia, Newark, N.J.) with the ultraviolet lamp set to 300 watts and the conveyor traveling at 20 feet per minute. It is believed that the resulting image will be of high quality and high resolution. The donor sheet can subsequently be re-toned, or cleaned and then re-toned for subsequent development processes.

EXAMPLE II

A curable liquid suitable for use in continuous stream ink jet processes is prepared as follows. A solution is prepared by mixing together 90 grams of triethylene glycol divinylether (Rapi-Cure DVE-3, available from GAF, Bound Brook, N.J.), and 5.0 grams of a sulfonium salt initiator, FX-512 (available from 3M, Minneapolis, Minn.).

An image is generated by incorporating the liquid thus prepared into a Compact Coder 2001 continuous ink jet printer (Mathews International Corp., Pittsburgh, Pa.) and jetting the liquid onto a paper substrate. The liquid image on the paper is then contacted with a donor roll coated with a uniform layer of xerographic toner particles 8 to 10 microns in average diameter. This particulate layer is doctored onto the donor roll by an elastomer blade or by a metering rod as is done in single component xerographic development processes. The toner particles adhere to those areas of the receiver sheet bearing the liquid image, and when the donor and receiver surfaces are separated, the toner particles are selectively transferred from the donor roll to the paper to form a colored image corresponding to the liquid image. Thereafter, the image is fixed by passing the paper bearing the image through a Hanovia UV-6 cure station (Hanovia, Newark, N.J.) with the ultraviolet lamp set to 100 watts and the conveyor traveling at 10 feet per minute. It is believed that the resulting image will be of high quality and high resolution.

EXAMPLE III

A curable liquid suitable for use in piezoelectric drop-on-demand ink jet processes is prepared as follows. A solution is prepared by mixing together 90 grams of butanediol divinyl ether, and 5.0 grams of a sulfonium salt initiator, UVI-6990 (available from Union Carbide, Danbury, Conn.).

An image is generated by incorporating the liquid thus prepared into a Xerox® 4020 piezoelectric ink jet printer and jetting the liquid onto a paper substrate. The liquid image on the paper is then contacted with a donor element comprising a Mylar® support onto which a thin layer of a pigment such as a metal free phthalocyanine or a dye has been vacuum evaporated. The pigment layer is easily fractured, and on areas of the receiver sheet bearing the tacky liquid image, the pigment is transferred imagewise from the donor element to the receiver sheet to form a colored image corresponding to the liquid image. Thereafter, the image is fixed by passing the paper bearing the image through a Hanovia UV-6 cure station (Hanovia, Newark, N.J.) with the ultraviolet lamp set to 75 watts and the conveyor traveling at 1 to 5 feet per minute. It is believed that the resulting image will be of high quality and high resolution. This process illustrates a method of producing imagewise patterns of materials that are otherwise difficult to use in imaging processes.

EXAMPLE IV

A curable liquid suitable for use in thermal (bubble-jet) drop-on-demand ink jet processes is prepared as follows. A solution is prepared by mixing together 90 grams of triethylene glycol divinylether (Rapi-Cure DVE-3, available from GAF, Wayne, N.J.), 7.5 grams of a sulfonium salt initiator, FX-512 (available from 3M, Minneapolis, Minn.), 90 grams of ethylene glycol, and 90 grams of water.

An image is generated by incorporating the liquid thus prepared into a Hewlett-Packard ThinkJet thermal ink jet printer and jetting the liquid onto a paper substrate. The liquid image on the paper is then contacted with a donor element comprising a Mylar® support coated with a thin layer of wax onto which has been deposited a monolayer of glass reflector beads which are to be transferred imagewise to the receiver sheet. On areas of the receiver sheet bearing the tacky liquid image, glass beads are transferred adhesively from the donor to the receiver to form the desired pattern of glass beads corresponding to the liquid image. Thereafter, the image is fixed by passing the paper bearing the image through a Hanovia UV-6 cure station (Hanovia, Newark, N.J.) with the ultraviolet lamp set to 100 watts and the conveyor traveling at 5 feet per minute.

Other embodiments and modifications of the present invention may occur to those skilled in the art subsequent to a review of the information presented herein; these embodiments and modifications, as well as equivalents thereof, are also included within the scope of this invention.

What is claimed is:

1. A process for forming images which comprises, in the order stated:

(a) applying a curable liquid to a first substrate in an image pattern, (b) optionally transferring the curable liquid image to a second substrate, (c) subsequently contacting the curable liquid image with a solid developer so that the developer adheres to the curable liquid image, (d) optionally transferring the curable liquid and the solid developer in image pattern to a third substrate, and (e) curing the curable liquid in the image pattern to a solid.

2. A process according to claim 1 wherein the curable liquid is applied to the substrate by a polarizable liquid development process.

3. A process according to claim 2 wherein the curable liquid has a viscosity of from about 25 to about 500 centipoise.

4. A process according to claim 35 2 wherein the curable liquid has a viscosity of from about 30 to about 300 centipoise.

5. A process according to claim 2 wherein the curable liquid has a resistivity of from about $10^8$ to about $10^{11}$ ohm-cm.

6. A process according to claim 2 wherein the curable liquid has a resistivity of $2\times10^9$ to about $10^{10}$ ohm-cm.

7. A process according to claim 2 wherein the curable liquid contains a viscosity controlling agent.

8. A process according to claim 1 wherein the curable liquid is applied to the substrate by an ink jet process.

9. A process according to claim 8 wherein the curable liquid is applied to the substrate by a continuous stream ink jet process.

10. A process according to claim 9 wherein the curable liquid has a surface tension greater than about 35 $mN\cdot m^{-1}$.

11. A process according to claim 9 wherein the curable liquid has a conductivity greater than about $10^{-3}$ $(ohm\text{-}cm)^{-1}$.

12. A process according to claim 9 wherein the curable liquid has a viscosity of from about 1 to about 2 $mN\cdot s\cdot m^{-2}$.

13. A process according to claim 8 wherein the curable liquid is applied to the substrate by a piezoelectric drop on demand ink jet process.

14. A process according to claim 13 wherein the curable liquid has a surface tension of greater than about 35 $mN\cdot m^{-1}$.

15. A process according to claim 13 wherein the curable liquid has a viscosity of from about 1 to about 10 $mN\cdot s\cdot m^{-2}$.

16. A process according to claim 8 wherein the curable liquid is applied to the substrate by a thermal drop on demand ink jet process.

17. A process according to claim 16 wherein the curable liquid has a surface tension of greater than about 35 $mN\cdot m^{-1}$.

18. A process according to claim 16 wherein the curable liquid has a viscosity of from about 1 to about 10 $mN\cdot s\cdot m^{-2}$.

19. A process according to claim 1 wherein the curable liquid is selected from the group consisting of ethylenically unsaturated compounds.

20. A process according to claim 1 wherein the curable liquid is selected from the group consisting acrylates, methacrylates, epoxies, vinyl ethers, styrenes, indenes, vinyl acetals, and mixtures thereof.

21. A process according to claim 1 wherein the curable liquid comprises molecules having moieties selected from the group consisting of cinnamic groups, fumaric groups, maleic groups, maleimido groups, and mixtures thereof.

22. A process according to claim 1 wherein the curable liquid contains an initiator.

23. A process according to claim 1 wherein the solid developer contains an initiator.

24. A process according to claim 1 wherein the curable liquid is partially polymerized prior to contacting the liquid image with the developer, thereby enhancing the tack of the liquid image.

25. A process according to claim 1 wherein the developer is applied to the liquid by preparing a donor element comprising a support and a releasable layer of the developer on the support, contacting the layer of developer on the donor element with the liquid image, and subsequently separating the donor element and the substrate, thereby causing the developer to separate from the support in an image pattern corresponding to the liquid image.

26. A process according to claim 25 wherein the donor element comprises a support and a layer of developer particles.

27. A process according to claim 26 wherein subsequent to separation of the donor element and the substrate, the developer remaining on the support of the donor layer is fixed to the support.

28. A process according to claim 27 wherein the support is transparent.

29. A process according to claim 25 wherein the donor element comprises a support and a frangible layer of developer.

30. A process according to claim 29 wherein the frangible layer comprises a metal.

31. A process according to claim 30 wherein the metal is selected from the group consisting of antimony, aluminum, silver, and mixtures thereof.

32. A process according to claim 29 wherein the frangible layer comprises a dye.

33. A process for forming images which comprises, in the order stated:

(a) applying a curable liquid to a first substrate in an image pattern, (b) optionally transferring the curable liquid image to a second substrate, (c) subsequently contacting the curable liquid image with a solid developer so that the developer adheres to the curable liquid image, (d) optionally transferring the curable liquid and the solid developer in image pattern to a third substrate, and (e) subsequently curing the curable liquid in the image pattern to a solid, wherein the curable liquid is partially polymerized prior to contacting the liquid image with the developer, thereby enhancing the tack of the liquid image, and wherein the developer is applied to the liquid by preparing a donor element comprising a support and a releasable layer of the developer on the support, contacting the layer of developer on the donor element with the liquid image, and subsequently separating the donor element and the substrate, thereby causing the developer to separate from the support in an image pattern corresponding to the liquid image.

* * * * *